US011946334B2

(12) United States Patent
Zhao et al.

(10) Patent No.: US 11,946,334 B2
(45) Date of Patent: Apr. 2, 2024

(54) FLOW SPLITTING DEVICE FOR GAS REVERSE CIRCULATION DRILLING

(71) Applicants: CHINA PETROLEUM & CHEMICAL CORPORATION, Beijing (CN); SINOPEC PETROLEUM ENGINEERING TECHNOLOGY SERVICE CO., LTD, Beijing (CN); SINOPEC SHENGLI PETROLEUM ENGINEERING CO., LTD, Dongying (CN); DRILLING TECHNOLOGY RESEARCH INSTITUTE OF SINOPEC SHENGLI PETROLEUM ENGINEERING CO., LTD, Dongying (CN)

(72) Inventors: Chuanwei Zhao, Dongying (CN); Zhonghua Wu, Dongying (CN); Yanjun Zhou, Dongying (CN); Honglin Tang, Dongying (CN); Zhihe Liu, Dongying (CN); Xueliang Pei, Dongying (CN); Haoyu Sun, Dongying (CN); Zhenguo Su, Dongying (CN); Bo Kang, Dongying (CN); Hui Zhang, Dongying (CN); Huangang Zhu, Dongying (CN); Yongming Chen, Dongying (CN); Zhongshuai Chen, Dongying (CN)

(73) Assignees: CHINA PETROLEUM & CHEMICAL CORPORATION, Beijing (CN); SINOPEC PETROLEUM ENGINEERING TECHNOLOGY SERVICE CO., LTD, Beijing (CN); SINOPEC SHENGLI PETROLEUM ENGINEERING CO., LTD, Dongying (CN); DRILLING TECHNOLOGY RESEARCH INSTITUTE OF SINOPEC SHENGLI PETROLEUM ENGINEERING CO., LTD, Dongying (CN)

( * ) Notice: Subject to any disclaimer, the term of this patent is extended or adjusted under 35 U.S.C. 154(b) by 2 days.

(21) Appl. No.: 17/913,075

(22) PCT Filed: Sep. 30, 2020

(86) PCT No.: PCT/CN2020/119249

§ 371 (c)(1),
(2) Date: Sep. 20, 2022

(87) PCT Pub. No.: WO2021/203643
PCT Pub. Date: Oct. 14, 2021

(65) Prior Publication Data

US 2023/0147453 A1 May 11, 2023

(30) Foreign Application Priority Data

Apr. 6, 2020 (CN) ..... 202010262201.4

(51) Int. Cl.
*E21B 21/16* (2006.01)
*E21B 21/12* (2006.01)
*E21B 33/128* (2006.01)

(52) U.S. Cl.
CPC ..... *E21B 33/128* (2013.01); *E21B 21/12* (2013.01); *E21B 21/16* (2013.01)

(58) Field of Classification Search
CPC ..... E21B 33/128; E21B 21/12; E21B 21/16
See application file for complete search history.

(56) References Cited

U.S. PATENT DOCUMENTS 3,958,651 A 5/1976 Young
4,836,305 A * 6/1989 Curlett ..... E21B 21/08 175/320

(Continued)

FOREIGN PATENT DOCUMENTS

CN 102007264 A 4/2011
CN 104428486 A 3/2015

(Continued)

OTHER PUBLICATIONS

PCT/ISA/210 and PCT/ISA/237 dated Dec. 31, 2020, by the China National Intellectual Property Administration as the International Searching Authority for International Application No. PCT/CN2020/119249. (13 pages).

*Primary Examiner* — Taras P Bemko
(74) *Attorney, Agent, or Firm* — BUCHANAN, INGERSOLL & ROONEY PC

(57) ABSTRACT

A flow splitting device for gas reverse circulation drilling, including: an upper joint for connecting with a double-wall drill pipe; an inner tube which is arranged in the upper joint (Continued)

and defines a first passageway in communication with an inner chamber of the double-wall drill pipe, a second passageway in communication with an annular space in the double-wall drill pipe formed between the inner tube and the upper joint; a lower joint, having an upper end fixedly connected with the upper joint and a lower end for connecting with a drill tool; and a flow guiding member provided between the upper joint and the lower joint. A flexible sealing mechanism is provided outside the upper joint. The flexible sealing mechanism extends radially outward relative to the upper joint and the lower joint to form a sealing contact with a wellbore wall.

15 Claims, 5 Drawing Sheets

(56) References Cited

U.S. PATENT DOCUMENTS

| | | | | |
|---|---|---|---|---|
| 6,050,352 | A * | 4/2000 | Thompson | E21B 10/60 175/69 |
| 2008/0264690 | A1 | 10/2008 | Khan et al. | |
| 2013/0220622 | A1 | 8/2013 | Alhaug et al. | |
| 2015/0337610 | A1 | 11/2015 | Strachan | |

FOREIGN PATENT DOCUMENTS

| | | | |
|---|---|---|---|
| CN | 204386484 | U | 6/2015 |
| CN | 104818960 | A | 8/2015 |
| CN | 105756574 | A | 7/2016 |
| CN | 208456522 | U | 2/2019 |
| CN | 210105816 | U | 2/2020 |

* cited by examiner

FLOW SPLITTING DEVICE FOR GAS REVERSE CIRCULATION DRILLING

CROSS REFERENCE OF RELATED APPLICATION

The present application claims the priority of Chinese patent application No. 202010262201.4, entitled "Flow splitting device for gas reverse circulation drilling" and filed on Apr. 6, 2020, the entire content of which is incorporated herein by reference.

FIELD OF THE INVENTION

The present invention relates to the field of oil drilling, and more particularly, to a flow splitting device fir gas reverse circulation drilling.

BACKGROUND OF THE INVENTION

Gas reverse circulation drilling originated in the 1940s, and has been widely used in the fields of mineral exploration, water well drilling, oil drilling, or the like.

In gas reverse circulation drilling, circulating medium carries cuttings from the bottom of the wellbore in drilling, and returns upwards through a center passageway of the drill pipe to the surface. In this technique, a single-wall drill pipe, a double-wall drill pipe or a triple-wall drill pipe is usually used, wherein the double-wall drill pipe is the most common. In the gas reverse circulation drilling with the double-wall drill pipe, circulating medium, usually compressed gas, is pressed into an annulus of the double-wall drill pipe (that is, an annular space formed between an inner drill pipe and an outer drill pipe) to enter a conventional drill tool, finally flowing to the drill bit. The compressed gas returned from the drill bit carries cuttings and enters a flow splitting device after passing through an annulus between the conventional drill pipe and the wellbore, then flows in the inner drill pipe of the double-wall drill pipe, and finally returns to the surface.

In order to enable the cuttings-carrying gas from the drill bit can enter the inner drill pipe of the double-wall drill pipe after passing through the flow splitting device, the existing flow splitting device has an outer diameter generally close to the size of the wellbore, and are usually made of all-metal material.

However, when the outer diameter of the flow splitting device is close to the size of the wellbore, the drill pipe will easily get jammed at a position where the flow splitting device is located due to large falling objects from the wellbore wall above.

SUMMARY OF THE INVENTION

In view of the above technical problems, the present invention aims to provide a flow splitting device for gas reverse circulation drilling, which can prevent the drill pipe from being jammed due to falling objects, effectively block the annulus of the wellbore, and at the same time prolong the service life.

According to the present invention, a flow splitting device for gas reverse circulation drilling is proposed, comprising: an upper joint for connecting with a double-wall drill pipe; an inner tube, which is arranged in the upper joint and defines a first passageway in communication with an inner chamber of the double-wall drill pipe, a second passageway in communication with an annular space of the double-wall drill pipe formed between the inner tube and the upper joint; a lower joint, having an upper end fixedly connected with the upper joint and a lower end for connecting with a drill tool; and a flow guiding member provided between the upper joint and the lower joint, for allowing gas from the annular space of the double-wall drill pipe to enter into the drill tool after passing through the second passageway, and gas from the drill tool to return to a wellhead after passing through the first passageway and the inner chamber of the double-wall drill pipe. A flexible sealing mechanism is provided on the upper joint, so that the upper joint is rotatable relative to the flexible sealing mechanism, the flexible sealing mechanism extending radially outward relative to the upper joint and the lower joint to form a sealing contact with a wellbore wall.

According to an embodiment of the present invention, the flexible sealing mechanism comprises a plurality of sealing units arranged on the upper joint along an axial direction, each of the sealing units including a pressing disc arranged around an outer periphery of the upper joint, and a flexible ring fixed on the pressing disc, the flexible ring extending radially outward from the pressing disc to form the sealing contact with the wellbore wall.

According to an embodiment of the present invention, the flexible ring is embedded therein with a rigid ring, which is fixed on the pressing disc.

According to an embodiment of the present invention, the pressing disc has a step, on which the rigid ring and the flexible ring are both arranged.

According to an embodiment of the present invention, a plurality of axial slots spaced apart from each other is formed on an inner surface of the pressing disc, a wear-resistant strip being arranged in each of the axial slots.

According to an embodiment of the present invention, a first compensation member and a second compensation member are arranged on the outer periphery of the upper joint, the flexible sealing mechanism being arranged between the first compensation member and the second compensation member.

According to an embodiment of the present invention, engaging surfaces between adjacent pressing discs, between the pressing disc and the first compensation member and between the pressing disc and the second compensation member are each provided with a wear-resistant element.

According to an embodiment of the present invention, the wear-resistant element is configured as a column made of cemented carbide.

According to an embodiment of the present invention, a locking sleeve is provided on the upper joint for forming a fixing connection with an upper end of the first compensation member, and a lower end of the second compensation member is fixedly connected with the lower joint.

According to an embodiment of the present invention, a plurality of blind holes spaced from each other is formed in an outer surface of the upper joint, a wear-resistant column being arranged in each of the blind holes.

According to an embodiment of the present invention, the flow guiding member is a hollow cylinder, which has an inner chamber in communication with the first passageway. A third passageway extending through the flow guiding member axially is provided in a wall of the flow guiding member, wherein one end of the third passageway is in communication with the second passageway and the other end thereof is in communication with the drill tool.

According to an embodiment of the present invention, the flow guiding member comprises two third passageways radially opposite to each other, each third passageway being configured to have a cross section of arc shape.

According to an embodiment of the present invention, a first radial through hole is formed in a wall of the lower joint, and a second radial through hole is formed in the wall of the flow guiding member. The second radial through hole is at least partially aligned with the first radial through hole, so that the gas from the drill tool is able to enter the inner chamber of the flow guiding member after passing through the first radial through hole and the second radial through hole.

According to an embodiment of the present invention, the first radial through hole and the second radial through hole are coaxial, and both extend obliquely from bottom to top.

According, to an embodiment of the present invention, the flow guiding member comprises two second radial through holes radially opposite to each other, which are respectively located between two third passageways radially opposite to each other.

According to an embodiment of the present invention, the gas from the annular space of the double-wall drill pipe is compressed gas, and the gas from the drill tool carries cuttings.

BRIEF DESCRIPTION OF THE DRAWINGS

In the following the present invention will be explained in more detail by way of illustrative exemplary embodiments with reference to the accompanying drawings. In the drawings.

In the drawings, the same reference numerals refer to the same components. The drawings are not drawn to actual scale.

DETAILED DESCRIPTION OF THE EMBODIMENTS

The present invention will be described below with reference to the accompanying drawings in the context, directional terms "down," "downstream," "downward" and the like indicate a direction away from the wellhead, while directional terms "upper," "upstream," "upward" and the like indicate a direction toward the wellhead. In addition, the term "axial" or "longitudinal" indicates an up-down direction, while the term "radial" indicates a direction substantially perpendicular to the longitudinal direction.

Figure 1:
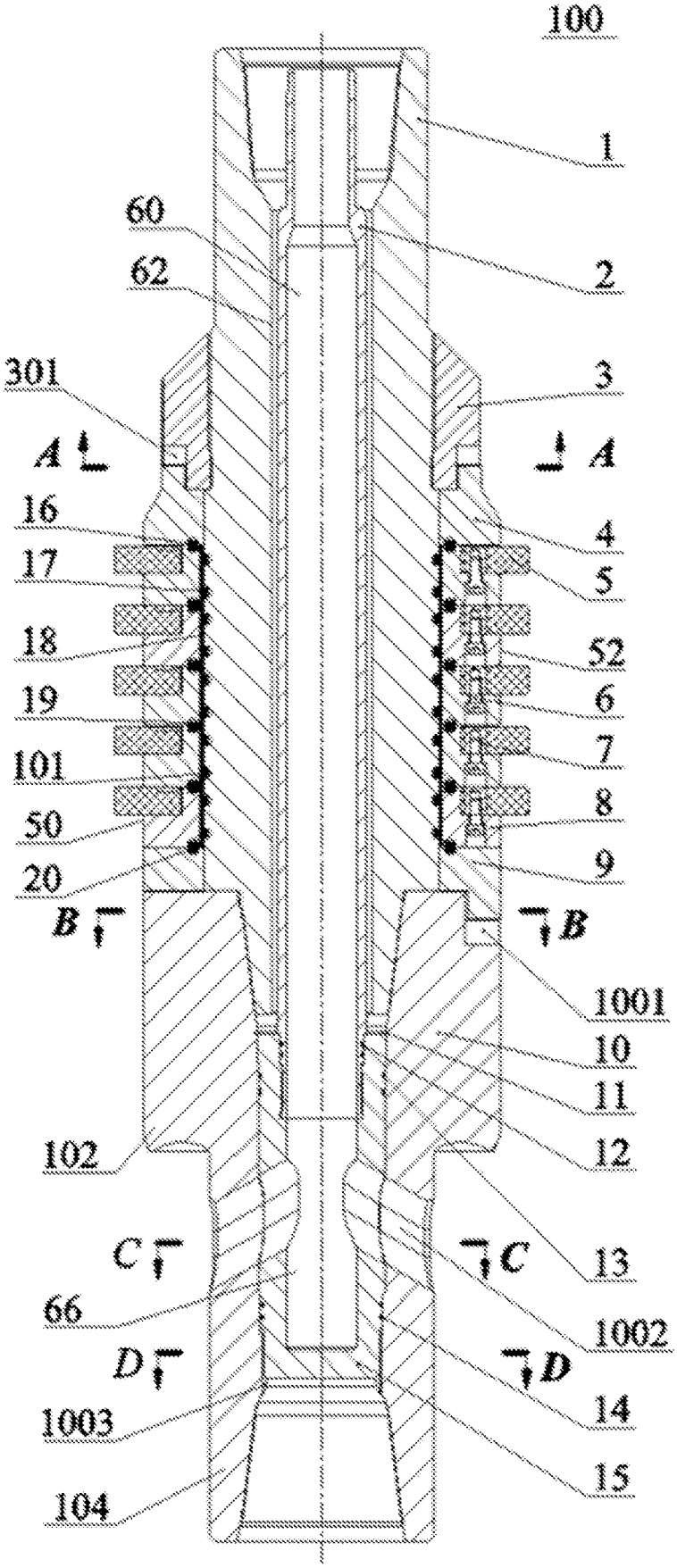
FIG. 1 schematically shows a cross-sectional view of the overall structure of a flow splitting device for gas reverse circulation drilling according to the present invention.

FIG. 1 shows a flow splitting device 100 for gas reverse circulation drilling according to one embodiment of the present invention. As shown in FIG. 1, the flow splitting device 100 for gas reverse circulation drilling according to the present invention includes an upper joint 1, and a lower joint 10 fixedly connected thereto. An inner tube 2 is arranged in the upper joint 1, and defines a first passageway 60 in its center.

Figure 10:
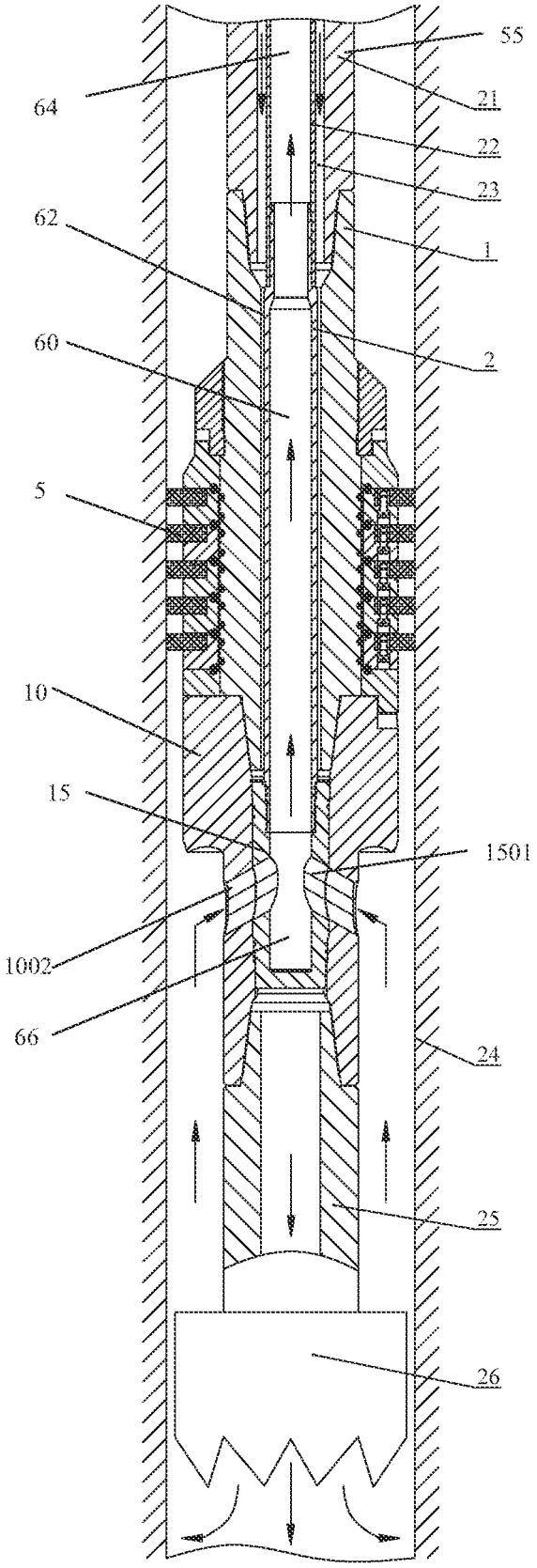
FIG. 10 schematically shows a state of the flow splitting device for gas reverse circulation drilling as shown in FIG. 1 when it is in downhole operation.

The upper joint 1 is provided at its upper end with a threaded buckle, for connecting with a double-wall drill pipe 55. As shown in FIG. 10, the double-wall drill pipe 55 includes an outer drill pipe 21 and an inner drill pipe 22. An annular space 23 is formed between the outer drill pipe 21 and the inner drill pipe 22, and an inner chamber 64 is defined in the inner drill pipe 22.

The inner tube 2 is arranged at a distance from an inner wall of the upper joint 1, so that an annular second passageway 62 (shown in FIG. 1) is formed between the inner tube 2 and the upper joint 1. When the upper joint 1 is connected with the double-wall drill pipe 55, the first passageway 60 of the inner tube 2 is in communication with the inner chamber 64 of the inner drill pipe 22, while the annular second passageway 62 between the inner tube 2 and the upper joint 1 is in communication with the annular space 23 between the outer drill pipe 21 and the inner drill pipe 22.

The lower joint 10 is connected with the upper joint 1 at a lower end of the upper joint 1, for example via threads. In the embodiment shown in FIG. 1, the lower end of the upper joint 1 is inserted into the lower joint 10, and fixedly connected therewith via threads. The inner tube 2 also extends into the lower joint 10.

The above structures of the upper joint 1 and the double-wall drill pipe 55 and the connection therebetween as well as the connection between the upper joint 1 and the lower joint 10 are well known to one skilled in the art, and thus detailed description in this regard is omitted here.

According to the present invention, a flexible sealing mechanism 50 is provided on the upper joint 1, and is capable of forming a sealing contact with a wellbore wall 24 (shown in FIG. 10), thereby sealing the downhole annulus.

Specifically, the flexible sealing mechanism 50 includes a plurality of sealing units 52 arranged on the upper joint 1 in an axial direction, Each sealing unit 52 includes a pressing disc 8 disposed on an outer periphery of the upper joint 1, and a flexible ring 5 fixed on the pressing disc 8. As shown in FIG. 10, the flexible ring 5 extends radially outward from the pressing disc 8, with its outer periphery forming a sealing contact with the wellbore wall 24, thereby sealing the downhole annulus, Since the sealing ring 5 is elastic, it can effectively seal with the wellbore wall 24. In one embodiment, the flexible ring 5 may be made of rubber material.

Figure 3:
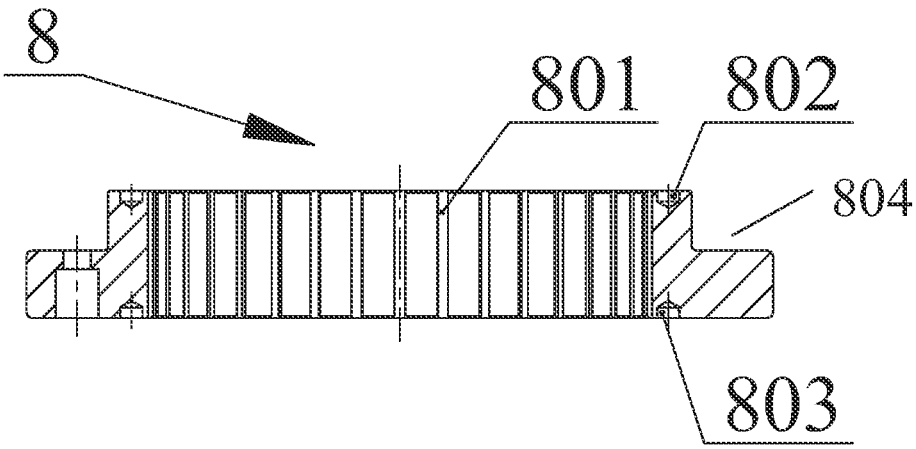
FIG. 3 schematically shows a cross-sectional view of a pressing disc used in the flow splitting device as shown in FIG. 1.

FIG. 3 shows a cross-sectional view of the pressing disc 8. As shown in this drawing, the pressing disc 8 is a hollow annular member, and has a step 804 formed on an outer periphery thereof so that the flexible ring 5 can be arranged on the step 804. The pressing disc 8 is usually made of metal. Multiple axial slots 801 spaced apart from each other are formed on an inner surface of the pressing disc 8, and a wear-resistant strip 18 is arranged in each of the axial slots 801. In a preferred embodiment, the wear-resistant strip 18 is made of cemented carbide. The axial slot 801 may be formed as a rectangular one, for example.

Holes 802 and 803 are respectively provided on two axial end faces of the pressing disc 8. A wear-resistant element 19 is disposed in each of the holes 802 and 803. For example, the wear-resistant element 19 can be configured as a cylinder, and has an end face, which is flush with the end face of the pressing disc 8 where said wear-resistant element 19 is located, and is in contact with the end face of an adjacent pressing disc 8. In this manner, wear generated between two adjacent pressing discs 8 can be reduced. The wear-resistant element 19 arranged in the hole 802 or the hole 803 of a pressing disc 8 can be axially aligned with that arranged in the hole 803 or the hole 802 of an adjacent pressing disc 8, or axially staggered from each other.

Returning to FIG. 1, according to the present invention, a rigid ring 7 is embedded within the flexible ring 5. As used herein, the term "embedded" indicates a fixed connection, such as by interference fit, bonding or the like. In one embodiment, the rigid ring 7 may be made of steel. The rigid ring 7 is fixed on the step 804 of the pressing disc 8 by a fastening bolt 6. In this manner, the pressing disc 8, the rigid ring 7 and the flexible ring 5 are formed as a whole.

During the gas reverse circulation drilling process, the upper joint 1 will rotate together with the double-wall drill pipe 55. However, the flexible ring 5 of the flexible sealing mechanism 50 is in sealing contact with the wellbore wall 25. Since the friction force generated between the flexible ring 5 and the wellbore wall 24 is generally large, and greater than the friction force generated between the pressing disc 8 made of metal and the upper joint 1 also made of metal, a combination consisting of the pressing disc 8, the rigid ring 7 and the flexible ring 5 does not rotate as a whole, so that the upper joint 1 will rotate relative to the combination consisting of the pressing disc 8, the rigid ring 7 and the flexible ring 5. In this case, since the flexible ring 5 remains stationary, the wear of the flexible ring 5 can be avoided, thus greatly improving the service life of the whole flow splitting device 100.

In addition, compared with the case where the flexible ring 5 is directly fixed on the pressing disc 8, the flexible ring 5 and the pressing disc 8 can be excellently fixed together by means of the rigid ring 7 embedded in the flexible ring 5 and fixed on the pressing disc 8. Therefore, the flexible ring 5 would not be easy to fall off from the pressing disc 8 even in severe downhole operations.

Moreover, according to the present invention, the sealing ring 5 of the flexible sealing mechanism 50 forms a sealing fit with the wellbore wall 24. Since the sealing ring 5 is elastic, it can effectively form a seal with the wellbore wall 24. Also, the lower joint 10, which is generally made of metal and located below the flexible sealing mechanism 50, is typically the component in the flow splitting device 100 with the largest diameter. Since the sealing ring 5 forms a sealing fit with the wellbore wall 24, the outer diameter of the lower joint 10 can be smaller. In this manner, the gap formed between the lower joint 10 made of metal and the wellbore wall 24 is larger, so that it can suitably allow larger falling objects to pass through, thus effectively preventing the drill pipe from being jammed at a position where the flow splitting device 100 is located.

According to a preferred embodiment of the present invention, a plurality of blind holes 101 with a certain depth are provided on an area of the outer periphery of the upper joint 1 where the flexible sealing mechanism 50 is arranged. These blind holes 101 are arranged along the axial and circumferential directions of the upper joint 1, and a wear-resistant column 17 is provided in each of the blind holes 101. In a preferred embodiment, the wear-resistant column 17 is made of cemented carbide. Wear caused by the rotation of the upper joint 1 relative to the pressing disc 8 can be abated by means of the wear-resistant columns 17 arranged on the outer periphery of the upper joint 1 and the wear-resistant strips 18 arranged on the inner surfaces of the pressing discs 8.

As shown in FIG. 1, the flexible sealing mechanism 50 includes five sealing units 52 arranged on the upper joint 1 and adjacent to each other along the longitudinal direction. It is easy to understand that the specific number of the sealing units 52 can be selected according to actual needs. In order to fix the flexible sealing mechanism 50, two compensation members are provided on the upper joint 1, namely, a first compensation member 4 and a second compensation member 9 located therebelow, and the flexible sealing mechanism 50 is arranged between the two compensation members.

Figure 2:
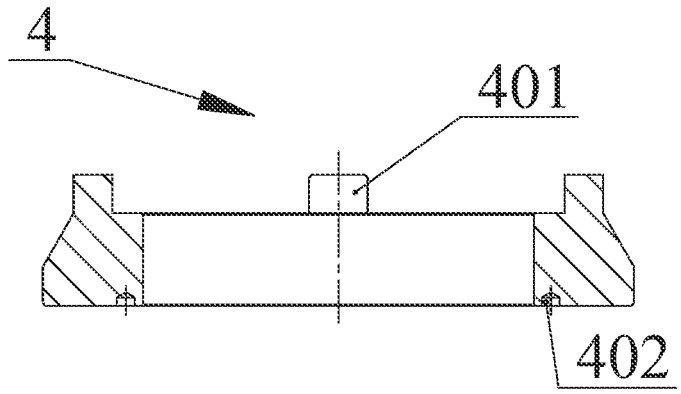
FIG. 2 schematically shows a cross-sectional view of a first compensation member used in the flow splitting device as shown in FIG. 1.
Figure 4:
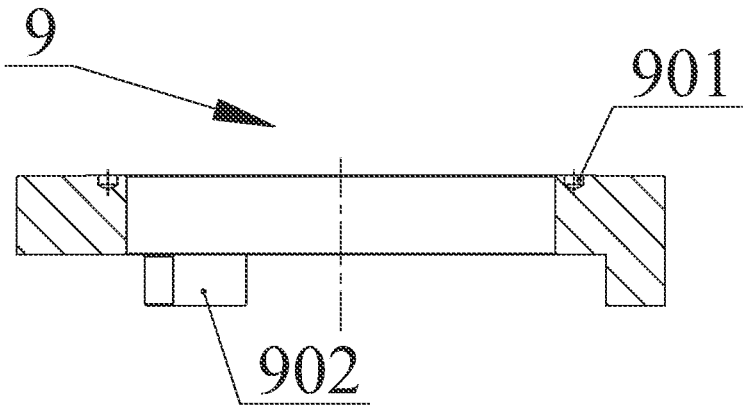
FIG. 4 schematically shows a cross-sectional view of a second compensation member used in the flow splitting device as shown in FIG. 1.
Figure 6:
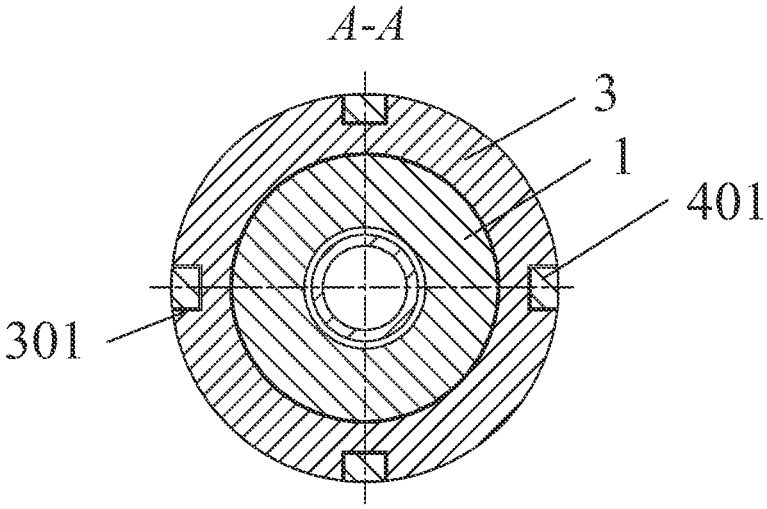
FIG. 6 is a cross-sectional view along line A-A in FIG. 1.

FIGS. 2 and 4 show a cross-sectional view of the first compensation member 4 and that of the second compensation member 9, respectively. As shown in FIG. 2, the first compensation member 4 is provided on its lower end face with a hole 402. Accordingly, through arranging a wear-resistant element 16 (shown in FIG. 1) in the hole 402 and the hole 802 of the upper end face of the pressing disc 8 adjacent to the first compensation member 4, wear generated between the first compensation member 4 and the pressing disc 8 adjacent thereto can be reduced, in a manner like the above-described wear-resistant column 17. In addition, the first compensation member 4 is provided on its upper end face with a key 401, for engaging with a corresponding keyway 301 (shown in FIG. 1) formed in a locking sleeve 3 arranged on the upper joint 1. FIG. 6 is a cross-sectional view along line A-A of FIG. 1, showing the specific engagement between the key and the keyway. In this manner, the first compensation member 4 can press against the flexible sealing mechanism 50 by the locking sleeve 3.

Figure 7:
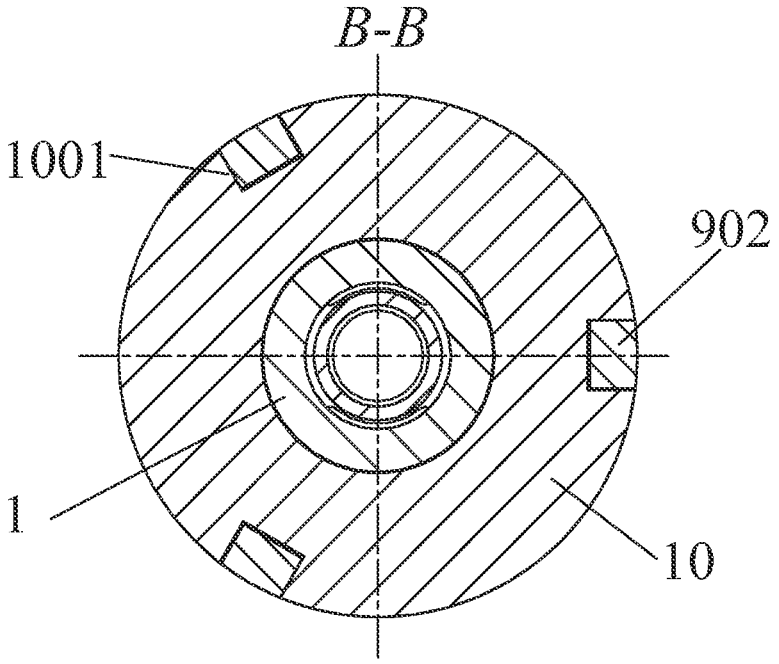
FIG. 7 is a cross-sectional view along B-B in FIG. 1.

Similarly, as shown in FIG. 4, the second compensation member 9 is provided on its upper end face with a hole 901. Accordingly, through arranging a wear-resistant element 20 (shown in FIG. 1) in the hole 901 and the hole 803 of the lower end face of the pressing disc 8 adjacent to the second compensation member 9, wear generated between the second compensation member 9 and the pressing disc 8 adjacent thereto can be reduced. In addition, the second compensation member 9 is provided on its lower end face with a key 902, for engaging with a corresponding keyway 1001 (shown in FIG. 1) formed in the lower joint 10. FIG. 7 is a cross-sectional view along line B-B of FIG. 1, showing the specific engagement between the key and the keyway.

In a preferred embodiment of the present invention, the wear-resistant elements 16, 19 and 20 are all made of cemented carbide, and each can be configured as having a cylindrical shape.

If none of the first compensation member 4 and the second compensation member 9 is used, the pressing disc 8 must be directly engaged with the locking sleeve 3 and the lower joint 10, respectively, which will cause wear of the locking sleeve 3 and the lower joint 10 during long-term operation. Unfortunately, the locking sleeve 3 and the lower joint 10 each are a relatively large component, with complex structure and high cost, if the locking sleeve 3 and the lower joint 10 have to be replaced when being seriously worn, related cost will be expensive. By adopting the first compensation member 4 and the second compensation member 9 each having a simple structure and low cost, the wear that may be generated can be transferred from the locking sleeve 3 and the lower joint 10 to the first compensation member 4 and the second compensation member 9. Therefore, by means of replacing the first compensation member 4 and the second compensation member 9 simply, the adverse effect caused by the above-mentioned wear can be overcome.

According to the present invention, a flow guiding member 15 is arranged in the lower joint 10. As shown in FIG. 1, the flow guiding member 15 is configured as a cylindrical member with one end open and the other end closed. The open end of the flow guiding member 15 is fixedly connected with a lower end of the inner tube 2 extending into the lower joint 10, for example, by threads. In this way, an inner chamber 66 of the flow guiding member 15 is in communication with the first passageway 60 of the inner tube 2 extending into the lower joint 10. In addition, a sealing ring 12 may be provided between the flow guiding member 15 and the inner tube 2, and sealing rings 13 and 14 may be provided between the flow guiding member 15 and the lower joint 10, for restricting undesired gas flow. An elastic retaining ring 11 is provided on an upper end of the flow guiding member 15, for limiting the position of the flow guiding member 15.

Figure 5:
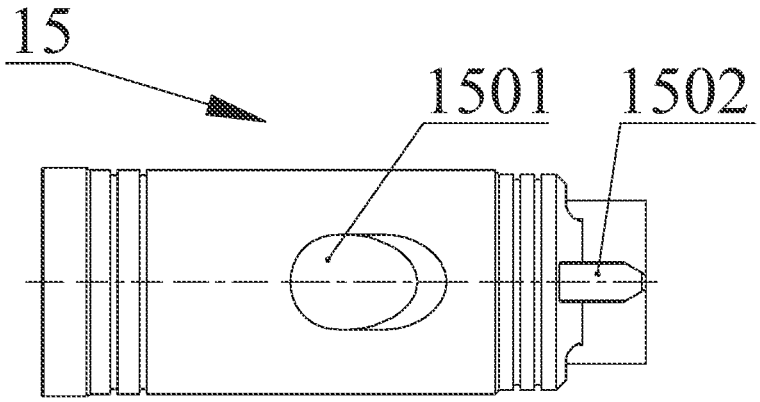
FIG. 5 schematically shows a front view of a flow guiding body used in the flow splitting device as shown in FIG. 1.
Figure 9:
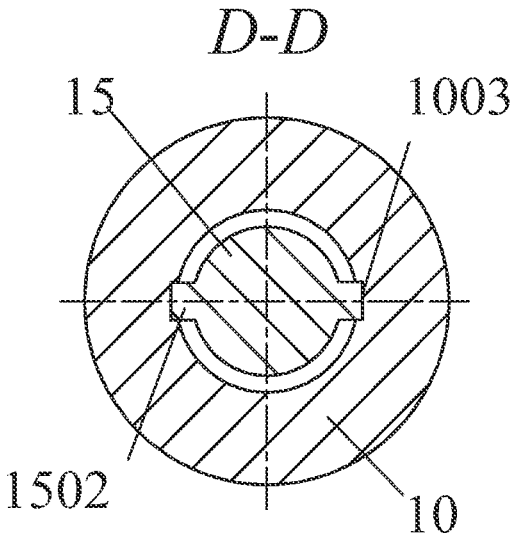
FIG. 9 is a cross-sectional view along line D-L) in FIG. 1.

FIG. 5 shows a front view of the flow guiding member 15. The flow guiding member 15 is provided in a lower region of its outer periphery with a key 1502, for engaging with a keyway 1003 provided on an inner surface of the lower joint 10. FIG. 9 is a cross-sectional view along line D-D of FIG. 1, showing the specific engagement between the key and the keyway.

A second radial through hole 1501 is formed in a side wall of the flow guiding member 15. Meanwhile, as shown in FIG. 1, a corresponding first radial through hole 1002 is also formed in a wall of the lower joint 10. The first radial through hole 1002 and the second radial through hole 1501 are in communication with each other. Preferably, the first radial through hole 1002 and the second radial through hole 1501 are coaxial, as shown in FIG. 1. In a preferred embodiment of the present invention, two second radial through holes 1501 radially opposite to each other are formed in the wall of the flow guiding member 15, and two second radial through holes 1501 radially opposite to each other are also formed in the wall of the lower joint 10. Each of the first radial through holes is aligned with a corresponding one of the second radial through holes. Details of this arrangement are shown in FIG. 8, which is a cross-sectional view along line C-C of FIG. 1.

Figure 8:
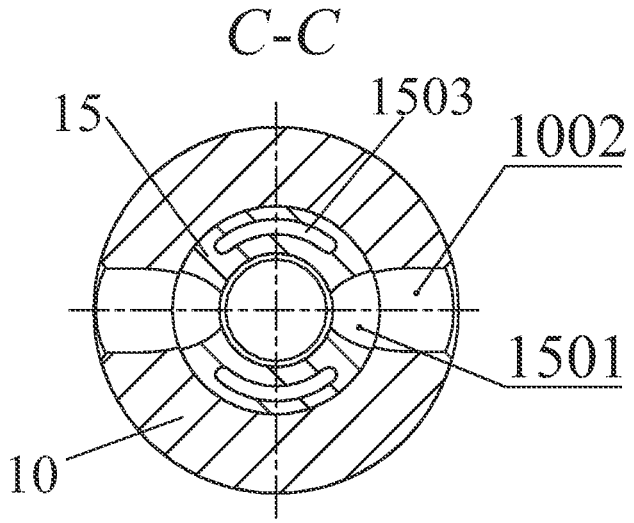
FIG. 8 is a cross-sectional view along line C-C in FIG. 1.

According to the present invention, a third passageway 1503 passing through the flow guiding member 15 along the longitudinal direction is further provided inside the side wall of the flow guiding member 15, as shown in FIG. 8. In the preferred embodiment shown in FIG. 8, two third passageways 1503 radially opposite to each other are provided, and respectively located between said two second radial through holes 1501 along the circumferential direction. Preferably, the third passageway 1503 is arc-shaped in the cross-sectional view. Since the third passageway 1503 passes through the flow guiding member 15 along the longitudinal direction, the third passageway 1503, on the one hand, is in communication with the second passageway 62 between the upper joint 1 and the inner tube 2 at its upper end, and on the other hand, is in communication with the drill tool 25 at its lower end.

As shown in FIG. 10, during the process of gas reverse circulation drilling, compressed gas from the wellhead enters the annular space 23 formed between the outer drill pipe 21 and the inner drill pipe 22 of the double-wall drill pipe 55, then enters the drill tool 25 after passing through the second passageway 62 between the upper joint 1 and the inner tube 2 and the third passageway 1503 in the flow guiding member 15, and finally enters the drill bit 26, from which compressed gas is discharged. Since multiple sealing rings 5 of the flexible sealing mechanism 50 of the flow splitting device 100 effectively block the annulus between the drill tool 25 and the wellbore wall 24, the gas carrying cuttings will enter the inner chamber 66 of the flow guiding member 15 after passing through the first radial passageway 1002 of the lower joint 10 and the second radial through hole 1501 of the flow guiding member 15, and then return to the wellhead through the first passageway 60 of the inner tube 2 and the inner chamber 64 of the inner drill pipe 22. In this manner, operations of gas reverse circulation drilling can be completed.

As shown in FIG. 1, according to a preferred embodiment of the present invention, in order to facilitate smooth flow of gas carrying cuttings into the inner chamber 66 of the flow guiding member 15, the first radial passageway 1002 and the second radial passageway 1501 that are coaxial with each other are each arranged to be inclined from bottom to top.

In the embodiment shown in FIG. 1, the lower joint 10 comprises a large section 102 and a small section 104 with different diameters. The lower joint 10 is connected to the upper joint 1 through the large section 102, but to the drill tool 25 through the small section 104. The first radial passageway 1002 is formed in the small section 104, The outer diameter of the pressing disc 8 is equal to that of the large section 102. The sealing rings 5 extend radially over the pressing disc 8 and the large section 102 to contact with the wellbore wall 24 in an effectively sealing manner. This structure is easy to manufacture and has high strength.

Although the present invention has been described with reference to preferred embodiments, various modifications and equivalent replacements can be made without departing from the scope of the present invention. In particular, as long as there is no structural conflict, each technical feature mentioned in each embodiment can be combined with each other in any manner. The present invention is not limited to the specific embodiments disclosed herein, but includes all technical solutions falling within the scope of the claims.

The invention claimed is:

1. A flow splitting device for gas reverse circulation drilling, comprising:

an upper joint for connecting with a double-wall drill pipe;

an inner tube, which is arranged in the upper joint and defines a first passageway in communication with an inner chamber of the double-wall drill pipe, a second passageway in communication with an annular space of the double-wall drill pipe formed between the inner tube and the upper joint;

a lower joint, having an upper end fixedly connected with the upper joint and a lower end for connecting with a drill tool; and a flow guiding member provided between the upper joint and the lower joint, for allowing gas from the annular space of the double-wall drill pipe to enter into the drill tool after passing through the second passageway, and gas from the drill tool to return to a wellhead after passing through the first passageway and the inner chamber of the double-wall drill pipe, wherein a flexible sealing mechanism is provided on the upper joint, so that the upper joint is rotatable relative to the flexible sealing mechanism, the flexible sealing mechanism extending radially outward relative to the upper joint and the lower joint to form a sealing contact with a wellbore wall, wherein the flexible sealing mechanism comprises a plurality of sealing units arranged on the upper joint along an axial direction, each of the sealing units including a pressing disc arranged around an outer periphery of the upper joint, and a flexible ring fixed on the pressing disc, the flexible ring extending radially outward from the pressing disc to form the sealing contact with the wellbore wall.

2. The flow splitting device for gas reverse circulation drilling according to claim 1, wherein the flexible ring is embedded therein with a rigid ring, which is fixed on the pressing disc.

3. The flow splitting device for gas reverse circulation drilling according to claim 2, wherein the pressing disc has a step, on which the rigid ring and the flexible ring are both arranged.

4. The flow splitting device for gas reverse circulation drilling according to claim 1, wherein a plurality of axial slots spaced apart from each other is formed on an inner surface of the pressing disc, a wear-resistant strip being arranged in each of the axial slots.

5. The flow splitting device for gas reverse circulation drilling according to claim 1, wherein a first compensation member and a second compensation member are arranged on the outer periphery of the upper joint, the flexible sealing mechanism being arranged between the first compensation member and the second compensation member.

6. The flow splitting device for gas reverse circulation drilling according to claim 5, wherein engaging surfaces between adjacent pressing discs, between the pressing disc and the first compensation member and between the pressing disc and the second compensation member are each provided with a wear-resistant element.

7. The flow splitting device for gas reverse circulation drilling according to claim 6, wherein the wear-resistant element is configured as a column made of cemented carbide.

8. The flow splitting device for gas reverse circulation drilling according to claim 5, wherein a locking sleeve is provided on the upper joint for forming a fixing connection with an upper end of the first compensation member, and a lower end of the second compensation member is fixedly connected with the lower joint.

9. The flow splitting device for gas reverse circulation drilling according to claim 1, wherein the gas from the annular space of the double-wall drill pipe is compressed gas, and the gas from the drill tool carries cuttings.

10. A flow splitting device for gas reverse circulation drilling, comprising:

an upper joint for connecting with a double-wall drill pipe;

an inner tube, which is arranged in the upper joint and defines a first passageway in communication with an inner chamber of the double-wall drill pipe, a second passageway in communication with an annular space of the double-wall drill pipe formed between the inner tube and the upper joint;

a lower joint, having an upper end fixedly connected with the upper joint and a lower end for connecting with a drill tool; and a flow guiding member provided between the upper joint and the lower joint, for allowing gas from the annular space of the double-wall drill pipe to enter into the drill tool after passing through the second passageway, and gas from the drill tool to return to a wellhead after passing through the first passageway and the inner chamber of the double-wall drill pipe, wherein a flexible sealing mechanism is provided on the upper joint, so that the upper joint is rotatable relative to the flexible sealing mechanism, the flexible sealing mechanism extending radially outward relative to the upper joint and the lower joint to form a sealing contact with a wellbore wall, wherein a plurality of blind holes spaced from each other is formed in an outer surface of the upper joint, a wear-resistant column being arranged in each of the blind holes.

11. A flow splitting device for gas reverse circulation drilling, comprising:

an upper joint for connecting with a double-wall drill pipe;

an inner tube, which is arranged in the upper joint and defines a first passageway in communication with an inner chamber of the double-wall drill pipe, a second passageway in communication with an annular space of the double-wall drill pipe formed between the inner tube and the upper joint;

a lower joint, having an upper end fixedly connected with the upper joint and a lower end for connecting with a drill tool; and a flow guiding member provided between the upper joint and the lower joint, for allowing gas from the annular space of the double-wall drill pipe to enter into the drill tool after passing through the second passageway, and gas from the drill tool to return to a wellhead after passing through the first passageway and the inner chamber of the double-wall drill pipe, wherein a flexible sealing mechanism is provided on the upper joint, so that the upper joint is rotatable relative to the flexible sealing mechanism, the flexible sealing mechanism extending radially outward relative to the upper joint and the lower joint to form a sealing contact with a wellbore wall, wherein the flow guiding member is a hollow cylinder, which has an inner chamber in communication with the first passageway; and a third passageway extending through the flow guiding member axially is provided in a wall of the flow guiding member, wherein one end of the third passageway is in communication with the second passageway and the other end thereof is in communication with the drill tool.

12. The flow splitting device for gas reverse circulation drilling according to claim 11, wherein the flow guiding member comprises two third passageways radially opposite to each other, each third passageway being configured to have a cross section of arc shape.

13. The flow splitting device for gas reverse circulation drilling according to claim 12, wherein a first radial through hole is formed in a wall of the lower joint, and a second radial through hole is formed in the wall of the flow guiding member, and the second radial through hole is at least partially aligned with the first radial through hole, so that the gas from the drill tool is able to enter the inner chamber of the flow guiding member after passing through the first radial through hole and the second radial through hole.

14. The flow splitting device for gas reverse circulation drilling according to claim 13, wherein the first radial through hole and the second radial through hole are coaxial, and both extend obliquely from bottom to top.

15. The flow splitting device for gas reverse circulation drilling according to claim 13, wherein the flow guiding member comprises two second radial through holes radially opposite to each other, which are respectively located between two third passageways radially opposite to each other.

* * * * *